US009358805B1

(12) United States Patent
Ho

(10) Patent No.: US 9,358,805 B1
(45) Date of Patent: Jun. 7, 2016

(54) ENVELOPE PRINTING MODE SWITCH

(71) Applicant: DELL PRODUCTS L.P., Round Rock, TX (US)

(72) Inventor: Wai Yuen Ho, Singapore (SG)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 14/621,065

(22) Filed: Feb. 12, 2015

(51) Int. Cl.
*B41J 2/335* (2006.01)

(52) U.S. Cl.
CPC ..... *B41J 2/3354* (2013.01)

(58) Field of Classification Search
USPC ..... 347/171, 197, 198
See application file for complete search history.

(56) References Cited

U.S. PATENT DOCUMENTS

| | | | | |
|---|---|---|---|---|
| 4,919,553 | A * | 4/1990 | Ueno | B41J 33/388 347/197 |
| 7,780,367 | B2 * | 8/2010 | Yoshioka | B41J 2/32 347/198 |
| 7,852,360 | B2 * | 12/2010 | Takahashi | B41J 2/32 347/198 |
| 2006/0082636 | A1 * | 4/2006 | Maruyama | B41J 2/325 347/197 |

* cited by examiner

*Primary Examiner* — Kristal Feggins
(74) *Attorney, Agent, or Firm* — Baker Botts L.L.P.

(57) ABSTRACT

A laser printer fuser assembly in a laser printer includes a lever to control envelope mode printing. The lever may protrude from an external surface of the laser printer and may provide a first position for normal paper printing, a second position for envelope printing, and a third position for jam clearing in the laser printer. The first position may apply a maximum force between a fuser heat roll and a pressure roll in the laser fuser printer assembly. The second position may apply a reduced force instead of the maximum force, while the third position may apply zero force. The first and second position may be accessible without opening a cover panel of the laser printer.

20 Claims, 4 Drawing Sheets

ENVELOPE PRINTING MODE SWITCH

BACKGROUND

1. Field of the Disclosure

This disclosure relates generally to printers for information handling systems and more particularly to an envelope printing mode switch.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Laser printers are commonly used with information handling systems in many private and enterprise environments. Laser printers may be integrated with information handling systems using printer drivers and software for selecting a target laser printer, specifying device parameters for the target laser printer, and sending print jobs to the target laser printer. Among the device parameters for a laser printer is selection of a printing media, such as plain paper or envelopes.

SUMMARY

In one aspect, a disclosed method includes, responsive to first user input positioning a lever from a first position to a second position, reducing a force between a fuser heat roll and a pressure roll in a laser printer fuser assembly. In the method, the lever may be coupled to a spring providing the force. In the method, the force may have a maximum value at the first position. In the method, the force may have a reduced value at the second position. Responsive to second user input positioning the lever from the second position to a third position, the method includes reducing the force to zero when the lever is at the third position. In the method, the lever may rotate about a fixed pivot point.

In any of the disclosed embodiments of the method, the first user input may be received externally at a laser printer including the laser printer fuser assembly when a cover panel included in the laser printer is closed, the cover panel including an opening through which the lever protrudes.

Other disclosed aspects include the laser printer fuser assembly and the laser printer including the laser printer fuser assembly.

BRIEF DESCRIPTION OF THE DRAWINGS

For a more complete understanding of the present invention and its features and advantages, reference is now made to the following description, taken in conjunction with the accompanying drawings, in which.

DESCRIPTION OF PARTICULAR EMBODIMENT(S)

Figure 1:
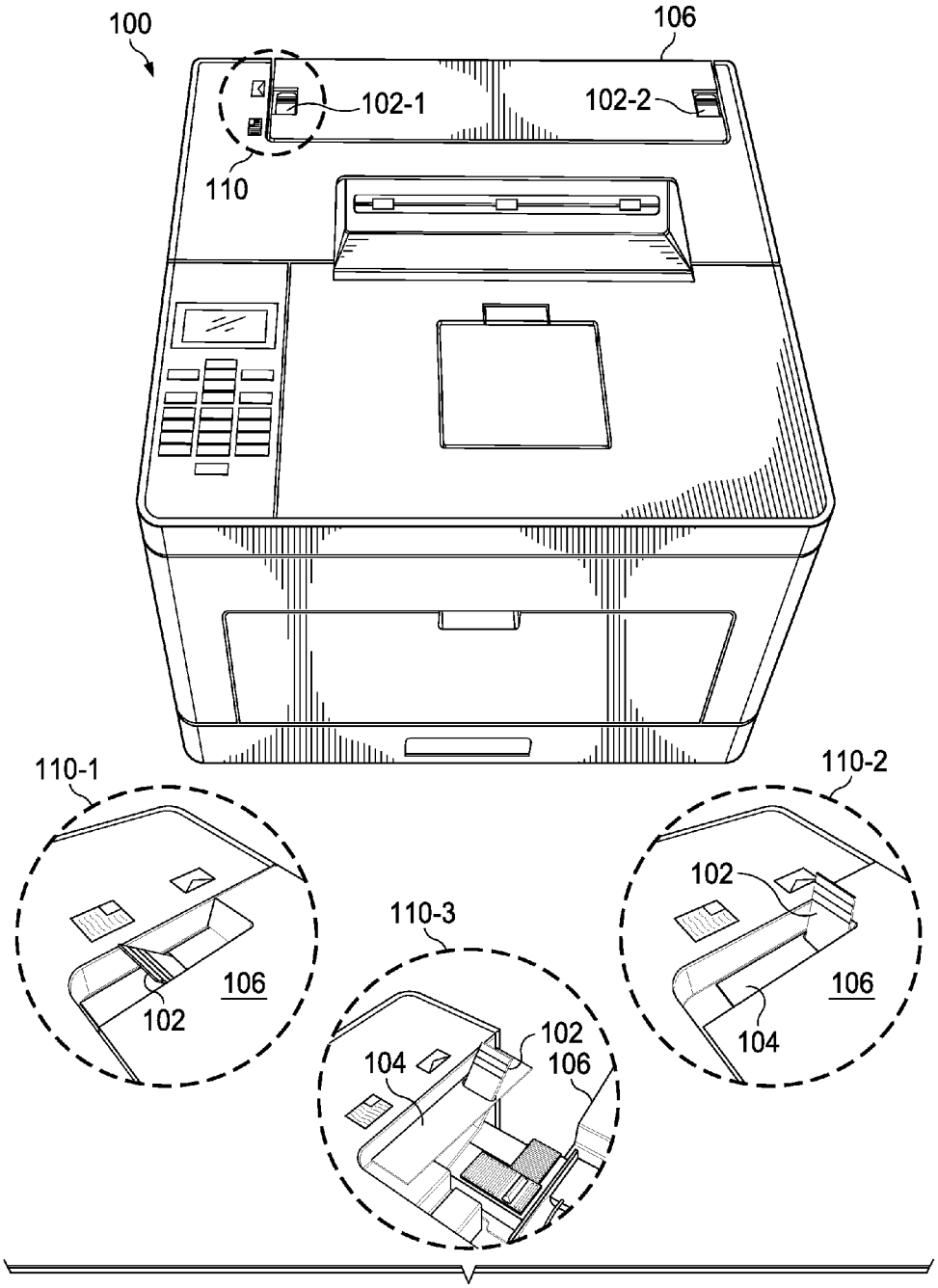
FIG. 1 is a diagram of selected elements of an embodiment of a laser printer with an envelope printing mode switch.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, as an example (not shown in the drawings), widget "12-1" refers to an instance of a widget class, which may be referred to collectively as widgets "12" and any one of which may be referred to generically as a widget "12". In the figures and the description, like numerals are intended to represent like elements.

As noted previously, many laser printers support selection of a printing media, such as plain paper or envelopes. In particular, envelope printing may be associated with certain mechanical settings within the laser printer due to the fact that an envelope comprises more than one sheet of paper in thickness when being processed through a laser printer. The additional thickness and multiple sheets in an envelope are particularly different than a single paper sheet during fusing, which applies heat and pressure to freshly printed media in the printing process of a laser printer. In a typical laser printer fuser assembly the freshly printed media is passed between a fuser heat roll and a pressure roll to fix the laser printed ink and make the printed media permanent. As a result of the specific heat and pressure applied to the print media during fusing, the fusing operation may be particular sensitive to the exact type of print media.

Many typical laser printers, such as laser printers in the entry-level to middle-market segments where a desired low price point may prohibit extensive automated solutions; such as using motion control systems (motor/gears/cam) in place of user intervention, provide a means for users to manually switch to an envelope mode for envelope printing. The manual switch enables a suitable amount of fusing pressure for the thicker multi-layered envelope media for proper printing. Generally, a lower fusing pressure is desirable for proper laser printing of envelopes as compared to laser printing of single sheets of paper. When the fusing pressure is not properly adjusted for envelope mode printing, the envelopes may emerge from the laser printer damaged or wrinkled when the higher pressure for single sheets of paper is applied. In such typical laser printers, envelope printing may be associated with relatively burdensome user interactions, such as having to turn a heavy laser printer around to access a mechanical envelope mode switching element. In some typical designs, envelope mode printing may be associated with an increase in the footprint that a laser printer uses due to additional space to allow for opening of printer covers during envelope printing.

Furthermore, previously known designs may rely upon a spacer to indirectly reduce the pressure in the laser printer fuser assembly.

As will be described in further detail, the inventors of the present disclosure have invented an envelope mode printing switch for a laser printer that enables switching between normal paper mode and envelope mode without turning the laser printer around and without opening a laser printer cover. As described in further detail herein, the disclosed envelope mode printing switch may be accessible to a user from an exterior surface, such as a top surface, of a laser printer to enable the user to select between normal paper and envelope printing.

Generally, a laser printer fusing assembly may enable or provide three different pressure levels of fusing pressure (or fusing force) in a laser printer. A first pressure level may correspond to maximum or full pressure (or maximum force) for plain paper printing, corresponding to a single sheet of paper passing in between the fuser heat roll and the pressure roll. A second pressure level may correspond to a reduced pressure (or reduced force) that is less than the maximum pressure for envelope printing, corresponding to the multiple sheets in an envelope. A third pressure level may correspond to zero pressure (or zero force), which may be applied to enable access to the laser printer fuser assembly, such as for clearing a printing media path when a paper jam or other error occurs, and for enabling the laser printer to recover from the error.

At maximum pressure, the operation of the fuser heat roll and the pressure roll may be optimized for fixing plain paper that has been printed by the laser printer, thereby prioritizing print quality and fusing permanence of the toners onto the paper. However, for thicker media, especially multi-sheet media such as an envelope, application of the maximum pressure in the laser printer fuser assembly may permanently crease or wrinkle the printed envelope, which may be unacceptable. The maximum pressure applied between the fuser heat roll and the pressure roll may result in air movement within the envelope and a corresponding sliding of the sheets of paper comprising the envelope while the envelope is passed through the laser printer fuser assembly, in a similar manner to the creasing observed during ironing of a fabric when the fabric is not properly laid flat. Accordingly, the reduced pressure value may mitigate envelope wrinkling and creasing. The zero pressure value may enable removal of print media by releasing the pressure between the fuser heat roll and the pressure roll in the laser printer fuser assembly, thereby enabling removal of the print media without significant damage to the print media, such as tearing or ripping.

Without the use of a spacer to control position and indirectly control force, the envelope mode printing switch disclosed herein may employ a lever with a cam profile that implements a 3-stage or 3-position pressure mechanism to adjust a spring that provides force between the fuser heat roll and the pressure roll in a laser printer fuser assembly. Additionally, the lever controlling the envelope mode printing switch disclosed herein may be exposed for user operation at a top surface of the laser printer, thereby enabling ease of access without moving the laser printer and without opening a cover panel of the laser printer to switch between normal paper mode and envelope mode printing. In particular embodiments, the lever controlling the envelope mode printing switch disclosed herein may be prevented from selecting the third pressure level corresponding to zero pressure until a rear cover panel of the laser printer is opened, which enables access for clearing paper jams in the laser printer.

Particular embodiments are best understood by reference to FIGS. 1, 2, 3A, 3B, 3C, and 4 wherein like numbers are used to indicate like and corresponding parts.

Turning now to the drawings, FIG. 1 illustrates a diagram depicting selected elements of an embodiment of a laser printer 100 with an envelope printing mode switch, as disclosed herein. As shown, laser printer 100 includes a laser printer fuser assembly, which is only partially visible in FIG. 1, incorporating the envelope printing mode switch disclosed herein. In FIG. 1, laser printer 100 includes a rear cover 106 and a printing mode lever 102, which may be duplicated for operation on either side of laser printer 100, shown as printing mode levers 102-1 and 102-2. In certain embodiments, a single printing mode lever 102 may be used with laser printer 100. Printing mode levers 102-1 and 102-2 may be internally coupled to a single common mechanism for envelope printing mode switch.

In FIG. 1, detail view 110 including printing mode lever 102-1 is replicated to show three different positions of printing mode lever 102. In detail view 110-1, rear cover 106 is closed and printing mode lever 102 is in a first position for normal paper mode printing. In detail view 110-2, rear cover 106 is closed and printing mode lever 102 is in a second position for envelope mode printing. Also visible in detail view 110-2 is sliding cover 104, which may be coupled to printing mode lever 102 and may accordingly slide with printing mode lever 102 when operated. Sliding cover 104 may cover or protect from exposure certain internal components of laser printer 100. In detail view 110-3, rear cover 106 is open and printing mode lever 102 is in a third position for print jam clearing, while sliding cover 104 is also visible. It is noted that when rear cover 106 is open, print media within laser printer 100 may be accessible for removal and jam clearing operations. In order to place printing mode lever 102 in the third position, rear cover 106 may be opened. In some embodiments, when printing mode lever 102 is in the third position, rear cover 106 may be prevented from closing.

Figure 2:
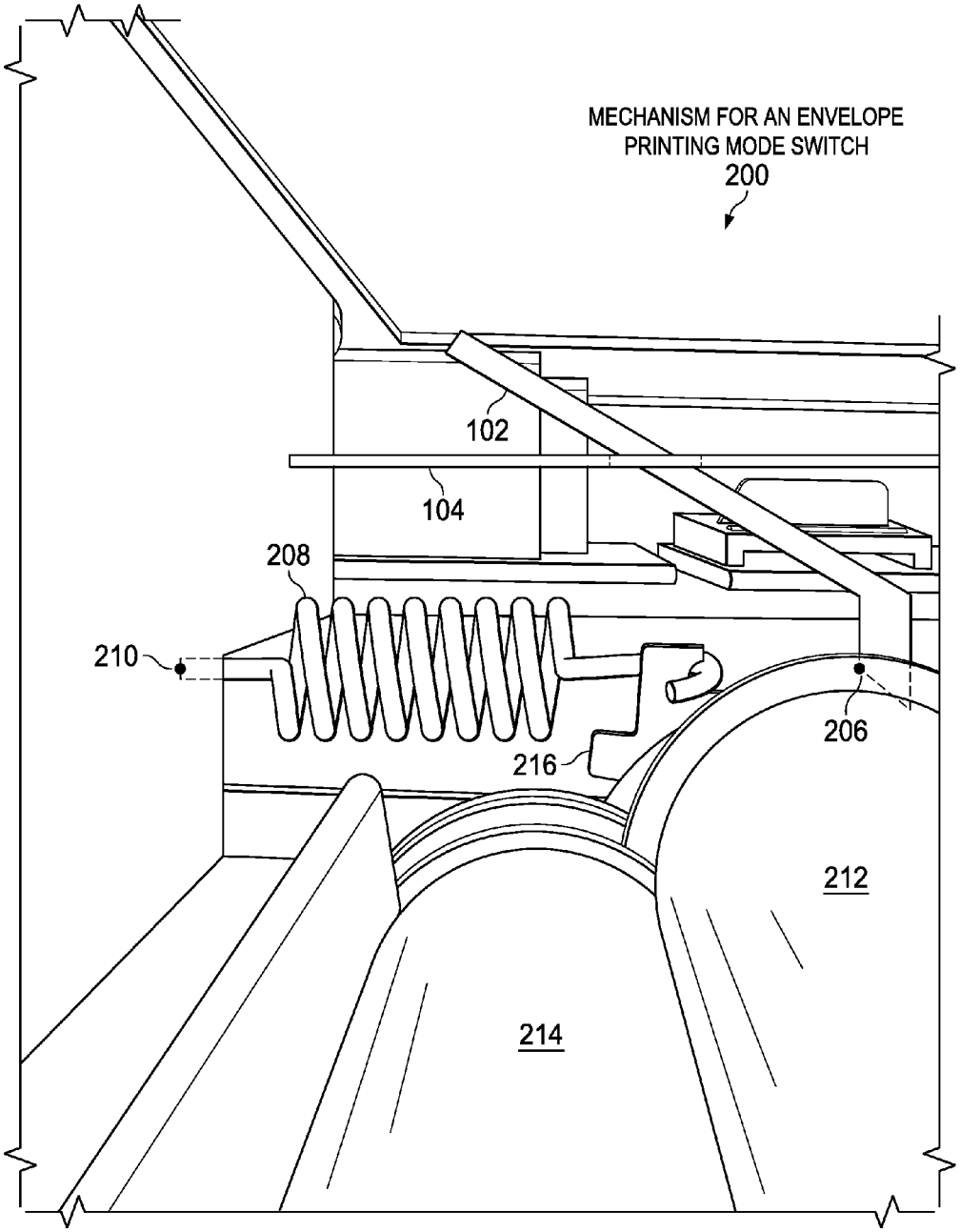
FIG. 2 is a diagram of selected elements of an embodiment of a mechanism for an envelope printing mode switch.

Referring now FIG. 2 a diagram of selected elements of an embodiment of a mechanism 200 for an envelope printing mode switch in a laser printer fuser assembly included in a laser printer. Mechanism 200 is an exemplary embodiment and is shown schematically and is not drawn to scale. It is noted that in different embodiments, mechanism 200 may be implemented with other elements or components. Mechanism 200 may be implemented using laser printer 100 in FIG. 1.

As shown, mechanism 200 may be employed to adjust the pressure (or force) between fuser heat roll 214 and pressure roll 212 in a laser printer fuser assembly included in a laser printer. Spring 208 may provide the force between fuser heat roll 214 and pressure roll 212. Fuser heat roll 214 may include a heating element and a temperature sensor, which are obscured from view in FIG. 2, to enable fuser heat roll 214 to operate at a desired temperature for fusing the print media after printing in the laser printer. A first endpoint 210 of spring 208 may be a fixed endpoint, which may be fixed at some interior location within the laser printer. Because spring 208 is oriented transverse to a rolling axis of both fuser heat roll 214 and pressure roll 212, spring 208 may cause a compressive force between fuser heat roll 214 and pressure roll 212, which is applied to the print media passing through between fuser heat roll 214 and pressure roll 212 during fusing (not shown in FIG. 2). A second endpoint of spring 208 may be attached to a bracket that is coupled to pressure roll 212 (see also FIG. 3), which may have a slightly movable rolling axis in a direction corresponding to spring 208 while fuser heat roll 214 may be fixed. The second end of spring 208 may also terminate in a connection to printing mode lever 102, which rotates about pivot point 206, which may be a fixed pivot point. Obscured from view in FIG. 2 is the cam profile which provides detention for printing mode lever 102 at the first position, the second position and the third position. As shown in FIG. 2, printing mode lever 102 is in the first position corresponding to normal paper printing and in the cam position corresponding to maximum force being applied by spring 208 to force fuser heat roll 214 and pressure roll 212 together. Sliding cover 104 is shown in a position corresponding to the first position of printing mode lever 102. Because printing mode lever 102 protrudes from a top surface of the laser printer, printing mode lever 102 may be accessible to the user for ease of operation.

Additionally, mechanism 200 may include a position sensor (not shown) to detect a position of lever 102 including the first position, the second position and the third position. The position sensor may provide a corresponding signal to a controller included with the laser printer. The controller may use the position information provided by the position sensor to correlate user actions, for example from a printer driver or other software used by the user on a computer system, with the actual state of lever 102.

Figure 3A:
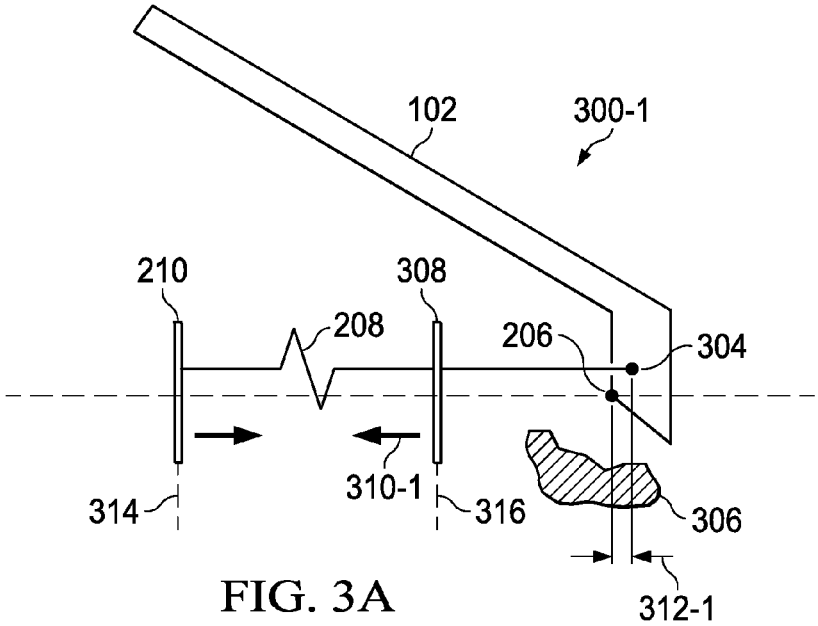
FIGS. 3A-3C are diagrams of selected elements of an embodiment of a mechanism for an envelope printing mode switch.

Referring now FIG. 3A a block diagram of selected elements of an embodiment of a mechanism 300-1 for an envelope printing mode switch in a laser printer fuser assembly included in a laser printer. Mechanism 300-1 is an exemplary embodiment and is shown schematically and is not drawn to scale. It is noted that in different embodiments, mechanism 300-1 may be implemented with other elements or components. Mechanism 300-1 may be an embodiment of mechanism 200 in FIG. 2.

In mechanism 300-1, further details are shown of an envelope printing mode switch in a laser printer fuser assembly included in a laser printer. Mechanism 300-1 corresponds to the first position of printing mode lever 102, as shown in FIG. 2. In mechanism 300-1, printing mode lever 102 may rotate about pivot point 206 but is detained in the first position by cam profile 306. Because printing mode lever 102 is attached to the second endpoint 304 of spring 208, the first position corresponds to a minimum displacement 312-1 of second endpoint 304, resulting in a maximum force 310-1 being applied. Spring 208 is shown with first endpoint 210, which is fixed, as well as bracket 308 that mates to pressure roll 212. In the first position, bracket 308 is at mating position 316 with pressure roll 212 to enable force to be applied by spring 208 to fuser heat roll 214 via pressure roll 212.

Figure 3B:
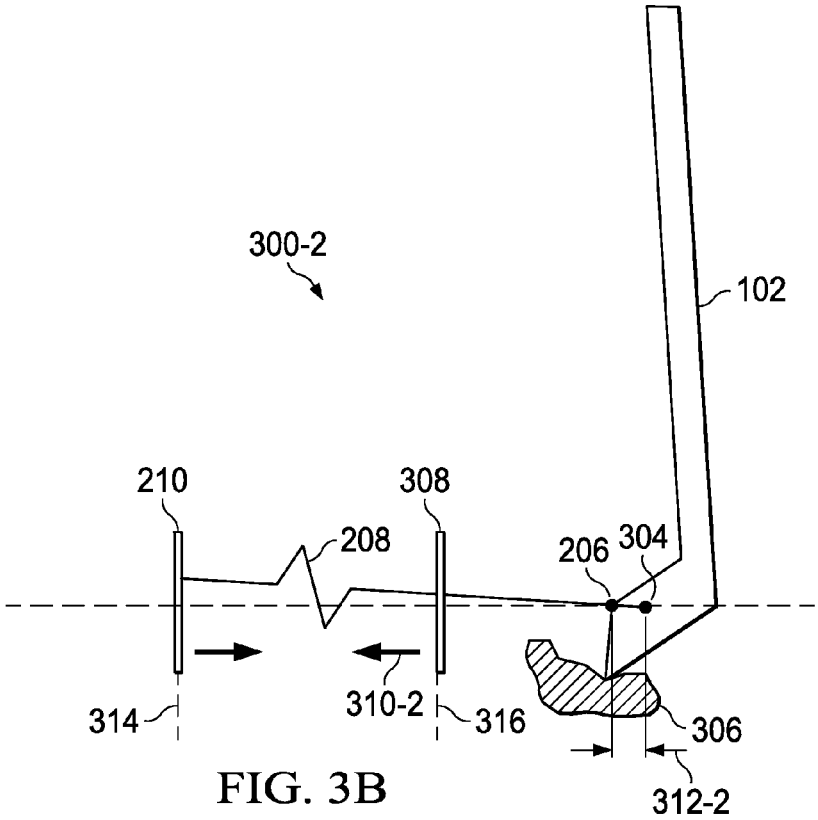

Referring now FIG. 3B a block diagram of selected elements of an embodiment of a mechanism 300-2 for an envelope printing mode switch in a laser printer fuser assembly included in a laser printer. Mechanism 300-2 is an exemplary embodiment and is shown schematically and is not drawn to scale. It is noted that in different embodiments, mechanism 300-2 may be implemented with other elements or components. Mechanism 300-2 may be an embodiment of mechanism 200 in FIG. 2.

In mechanism 300-2, further details are shown of an envelope printing mode switch in a laser printer fuser assembly included in a laser printer. Mechanism 300-2 corresponds to the second position of printing mode lever 102, corresponding to envelope mode printing. In mechanism 300-2, printing mode lever 102 may rotate about pivot point 206 but is detained in the second position by cam profile 306. Because printing mode lever 102 is attached to the second endpoint 304 of spring 208, the second position corresponds to an increased displacement 312-2 of second endpoint 304 as compared to minimum displacement 312-1, resulting in a reduced force 310-2 being applied as compared to maximum force 310-1. Spring 208 is shown with first endpoint 210, which is fixed, as well as bracket 308 that mates to pressure roll 212. In the second position, bracket 308 is at or near mating position 316 with pressure roll 212 corresponding to reduced force 310-2 being applied by spring 208 to fuser heat roll 214 via pressure roll 212.

Figure 3C:
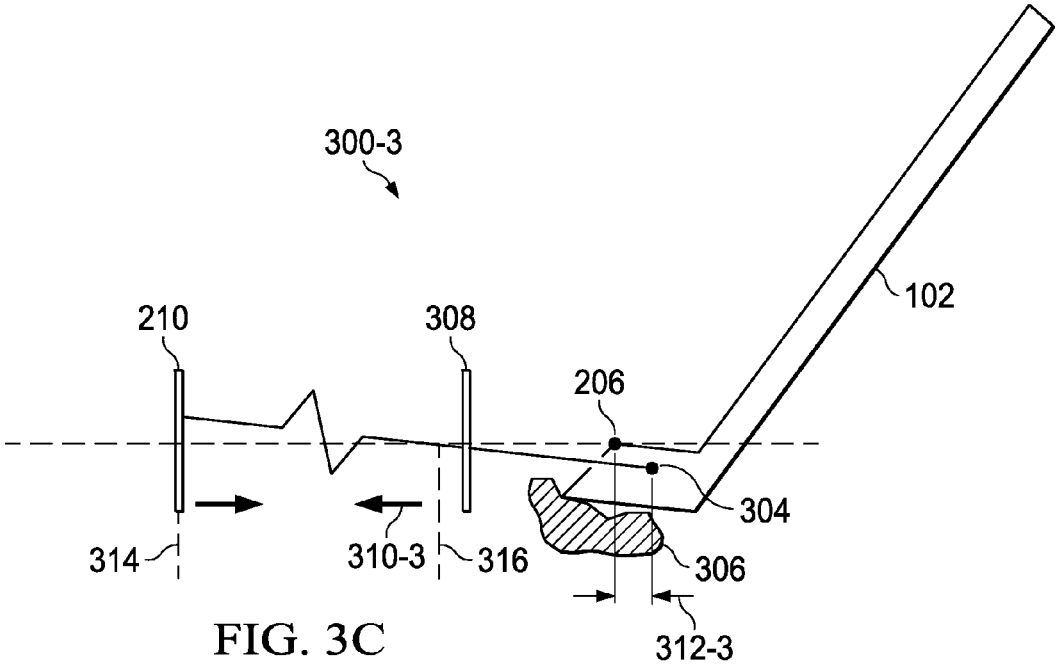

Referring now FIG. 3C a block diagram of selected elements of an embodiment of a mechanism 300-3 for an envelope printing mode switch in a laser printer fuser assembly included in a laser printer. Mechanism 300-3 is an exemplary embodiment and is shown schematically and is not drawn to scale. It is noted that in different embodiments, mechanism 300-3 may be implemented with other elements or components. Mechanism 300-3 may be an embodiment of mechanism 200 in FIG. 2.

In mechanism 300-3, further details are shown of an envelope printing mode switch in a laser printer fuser assembly included in a laser printer. Mechanism 300-3 corresponds to the third position of printing mode lever 102, corresponding to print jam clearing or other service operation in the laser printer. In mechanism 300-3, printing mode lever 102 may rotate about pivot point 206 but is detained in the third position by cam profile 306. It is noted that a rear cover of the laser printer may be open to allow for printing mode lever 102 to reach the third position. Because printing mode lever 102 is attached to the second endpoint 304 of spring 208, the third position corresponds to a maximum displacement 312-3 of second endpoint 304 as compared to other displacements 312, resulting in zero force 310-3 being applied. Spring 208 is shown with first endpoint 210, which is fixed, as well as bracket 308 that is released from pressure roll 212. In the third position, bracket 308 does not contact mating position 316 with pressure roll 212 corresponding to zero force 310-3 being applied by spring 208 to fuser heat roll 214 via pressure roll 212. In mechanism 300-3, pressure roll 212 may move apart from fuser heat roll 214.

Figure 4:
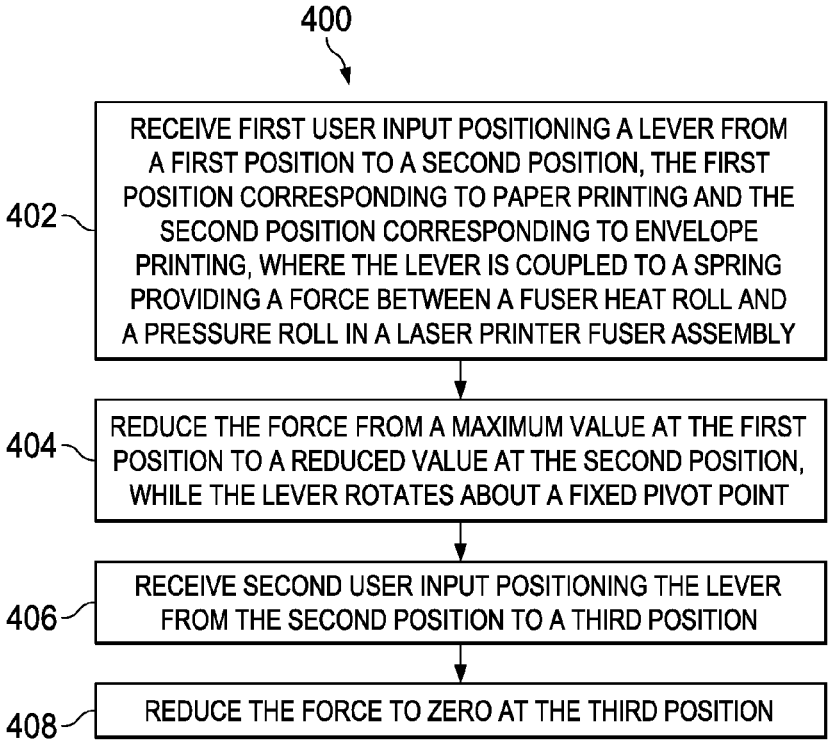
FIG. 4 is a flowchart of selected elements of a method of operation of an envelope printing mode switch.

Referring now to FIG. 4, selected elements of an embodiment of a method 400 for envelope printing mode switching, as described herein, are depicted in flowchart form. Method 400 may be implemented by laser printer 100 (see FIG. 1). It is noted that certain operations described in method 400 may be optional or may be rearranged in different embodiments.

Method 400 begins by receiving (operation 402) first user input positioning a lever from a first position to a second position, the first position corresponding to paper printing and the second position corresponding to envelope printing, where the lever is coupled to a spring providing a force between a fuser heat roll and a pressure roll in a laser printer fuser assembly. The force may be reduced (operation 404) from a maximum value at the first position to a reduced value at the second position, while the lever rotates about a fixed pivot point. Second user input may be received (operation 406) positioning the lever from the second position to a third position. The force may be reduced (operation 408) to zero at the third position. The second user input may include opening of a rear cover of the laser printer.

As disclosed herein, a thermal laser printer fuser assembly in a laser printer includes a lever to control envelope mode printing. The lever may protrude from an external surface of the laser printer and may provide a first position for normal paper printing, a second position for envelope printing, and a third position for jam clearing in the laser printer. The first position may apply a maximum force between a fuser heat roll and a pressure roll in the laser fuser printer assembly. The second position may apply a reduced force instead of the maximum force, while the third position may apply zero force. The first and second position may be accessible without opening a cover panel of the laser printer.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, features, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A method comprising:

responsive to first user input positioning a lever from a first position to a second position, reducing a force between a fuser heat roll and a pressure roll in a laser printer fuser assembly, wherein the lever is coupled to a spring providing the force, wherein the force has a maximum value at the first position and the force has a reduced value at the second position; and responsive to second user input positioning the lever from the second position to a third position, reducing the force to zero when the lever is at the third position, wherein the lever rotates about a fixed pivot point.

2. The method of claim 1, wherein the first user input is received externally at a laser printer including the laser printer fuser assembly when a cover panel included in the laser printer is closed, the cover panel including an opening through which the lever protrudes.

3. The method of claim 2, wherein the second user input is received at the laser printer when the cover panel is open, wherein the cover panel prevents the lever from reaching the third position when the cover panel is closed.

4. The method of claim 2, wherein the first user input is received at a top surface of the laser printer.

5. The method of claim 1, wherein the maximum force corresponds to a single sheet passing through the laser printer fuser assembly.

6. The method of claim 1, wherein the reduced force corresponds to an envelope passing through the laser printer fuser assembly.

7. A laser printer comprising:

a laser printer fuser assembly, further comprising:

a fuser heat roll for applying heat to a printing medium;

a pressure roll for applying pressure to the printing medium against the fuser heat roll;

a spring coupled to the fuser heat roll and the pressure roll to apply a pressure to the fuser heat roll via the pressure roll; and a lever attached to the spring and rotating about a fixed pivot point, wherein the lever is accessible for user input from an external surface of the laser printer, and wherein the lever is operable to:

responsive to first user input positioning the lever from a first position to a second position, reduce the pressure between the fuser heat roll and the pressure roll, wherein the pressure has a maximum value at the first position and the pressure has a reduced value at the second position; and responsive to second user input positioning the lever from the second position to a third position, reduce the pressure to zero when the lever is at the third position.

8. The laser printer of claim 7, wherein the first user input is received when a cover panel included in the laser printer is closed, the cover panel including an opening through which the lever protrudes.

9. The laser printer of claim 8, wherein the second user input is received when the cover panel is open, wherein the cover panel prevents the lever from reaching the third position when the cover panel is closed.

10. The laser printer of claim 7, wherein the lever is externally accessible at a top surface of the laser printer.

11. The laser printer of claim 7, wherein the maximum force corresponds to the printing medium being a single sheet.

12. The laser printer of claim 7, wherein the reduced force corresponds to the printing medium being an envelope.

13. The laser printer of claim 7, further comprising:

a position sensor to detect a position of the lever, the position selected from the first position, the second position, and the third position.

14. A laser printer fuser assembly comprising:

a fuser heat roll for applying heat to a printing medium;

a pressure roll for applying pressure to the printing medium against the fuser heat roll;

a spring coupled to the fuser heat roll and the pressure roll to apply a pressure to the fuser heat roll via the pressure roll; and a lever attached to the spring and rotating about a fixed pivot point, wherein the lever is accessible for user input from an external surface of a laser printer including the laser printer fuser assembly, and wherein the lever is operable to:

responsive to first user input positioning the lever from a first position to a second position, reduce the pressure between the fuser heat roll and the pressure roll, wherein the pressure has a maximum value at the first position and the pressure has a reduced value at the second position; and responsive to second user input positioning the lever from the second position to a third position, reduce the pressure to zero when the lever is at the third position.

15. The laser printer fuser assembly of claim 14, wherein the first user input is received when a cover panel included in the laser printer is closed, the cover panel including an opening through which the lever protrudes.

16. The laser printer fuser assembly of claim 15, wherein the second user input is received when the cover panel is open, wherein the cover panel prevents the lever from reaching the third position when the cover panel is closed.

17. The laser printer fuser assembly of claim 14, wherein the lever is externally accessible at a top surface of the laser printer.

18. The laser printer fuser assembly of claim 14, wherein the maximum force corresponds to a single sheet passing through the laser printer fuser assembly.

19. The laser printer fuser assembly of claim 14, wherein the reduced force corresponds to an envelope passing through the laser printer fuser assembly.

20. The laser printer fuser assembly of claim 14, further comprising:

a position sensor to detect a position of the lever, the position selected from the first position, the second position, and the third position.

* * * * *